United States Patent [19]

Smith

[11] 3,994,797

[45] Nov. 30, 1976

[54] ANODE JACK STOP LIMIT

[75] Inventor: Sam L. Smith, Golden, Colo.

[73] Assignees: National Steel Corporation, Pittsburgh, Pa.; Southwire Company, Carrollton, Ga.

[22] Filed: Mar. 24, 1975

[21] Appl. No.: 561,375

[52] U.S. Cl. ..... 204/225; 204/228

[51] Int. Cl.[2] ..... C25C 7/06; C25C 3/06

[58] Field of Search ..... 204/225, 228, 245, 67, 204/243 R

[56] References Cited

UNITED STATES PATENTS

| | | | |
|---|---|---|---|
| 3,329,592 | 7/1967 | Uhrenholdt | 204/225 |
| 3,434,945 | 3/1969 | Schmitt et al. | 204/225 |
| 3,761,379 | 9/1973 | Elliott | 204/225 |
| 3,902,983 | 9/1975 | Warren | 204/225 |

*Primary Examiner*—T. M. Tufariello

*Attorney, Agent, or Firm*—Van C. Wilks; Herbert M. Hanegan; Stanley L. Tate

[57] ABSTRACT

Apparatus for limiting the upward movement of the anodes of a computer-controlled aluminum reduction cell is disclosed. An air motor is connected with a jack for raising or lowering the superstructure supporting the cell anodes when air pressure is admitted to the motor in response to either a computer or cell-operator-initiated pilot air signal. Computer-generated pilot air signals of a time duration which could cause the air motor to raise the superstructure and create an open anode condition, are interrupted after a predetermined time period. A ball-cam valve is positioned in a fixed relation to the anode superstructure to interrupt either a computer or cell-operator-initiated "up" anode signal to the air motor when the anode superstructure reaches a predetermined upper limit.

9 Claims, 2 Drawing Figures

COMPUTER
26
CELL OPERATOR CONTROL PANEL
27

28
66
34
72
40
ANODE JACK CONTROL SYSTEM
36
AIR MOTOR
32
42
30
24
BALL CAM VALVE
ANODE JACK
38
39
19
18
10
16
16
16
16
+
22
V
−
14
20
12

32
34
48
AIR MOTOR
46
36
42
50
52
30
38
39
62
60
58
ACCUMULATOR
56
64
70
66
54
57
28
72
68
40

ANODE JACK STOP LIMIT

BACKGROUND OF THE INVENTION

This invention relates generally to electrolytic reduction cells, and more particularly to apparatus for limiting the extent of vertical movement of the electrode supporting and feeding means of an aluminum reduction cell.

In a conventional arrangement of an aluminum electrolytic reduction cell, one or more carbon anodes, each having a metal shaft embedded therein, is secured by its respective metal shaft to a vertically movable superstructure arranged in superposed relation to the vessel or pot of the electrolytic reduction cell. The cathode structure is usually in the form of collector bars disposed in the bottom of the vessel. During operation of the cell, the carbon anodes are immersed to a predetermined level in the molten electrolyte which forms the electrical path between the anode and cathode of the cell. As electrolytic reduction proceeds, variations in the desired cell voltage are caused by depletion of the alumina ore in the cell as well as consumption of the carbon anodes. To maintain cell voltage relatively constant, the anodes are raised and lowered in the electrolytic bath as necessary by means of hydraulic, pneumatic or electric jacks arranged to vary the vertical position of the anode supporting superstructure. Maintenance of alumina ore concentration within the limits of greatest cell efficiency also requires the periodic addition of controlled amounts of alumina as the ore in the cell is depleted by the reduction process.

Computer monitoring and control of the cell voltage, resistance, ore concentration and other operating parameters of aluminum reduction cells is well-known in the art. Typically, a computer-controlled reduction cell includes automatic means for raising and lowering the anode superstructure. One such system is disclosed in U.S. patent application Ser. No. 298,405, filed Oct. 18, 1972, now U.S. Pat. No. 3,888,747 entitled "Method of and Apparatus for Producing Metal" and assigned to the assignee of the present invention, the description of which is incorporated herein by reference. Should the computer in such a system malfunction or deliver a faulty signal to the jacks, it is possible to cause the anode superstructure to be raised to such an extent that an open cell is created, i.e., one or more anodes is raised out of the molten electrolyte, and, in extreme cases, the superstructure, jacks and associated hardware may be extensively damaged.

Concomitantly with computer control of the vertical position of the anode superstructure in an aluminum reduction cell, there is normally provided parallel means for allowing the cell operator to control the anode jack mechanism. The operator control may be in the form of a manual pushbutton which must be continually depressed to control an electrical, hydraulic or pneumatic system and cause vertical movement of the anode support structure, a voltage meter for monitoring cell voltage and an audible alarm and warning light for indicating the occurrence of an open anode. While the aforementioned cell-operator controls and warning devices are generally sufficient to avoid the open anode condition, there still remains the possiblity of human error in manual control of the jack resulting in extensive damage to the anode support structure and the loss of cell utilization during repairs.

SUMMARY OF THE INVENTION

In view of the foregoing, it should be apparent that there exists a need in the art for an anode jack control apparatus for use with an aluminum reduction cell to prevent the occurrence of a computer-caused open anode and, further, to prevent computer or cell-operator-caused damage to the anode support structure, and associated hardware. It is, therefore, a primary object of this invention to provide means for controlling the vertical movement of the anode support structure of an aluminum electrolytic reduction cell to prevent an open anode condition and damage to support structure for the anode.

More particularly, it is an object of this invention to provide an anode jack control system for interrupting the air supply to a pneumatically operated jack motor when either a predetermined upper position of the anode support structure has been reached or a computer-initiated signal has energized the jack motor for a predetermined time duration.

Another object of the present invention is to provide a simple yet effective apparatus for positively interrupting the upward movement of the anode support structure of an aluminum reduction cell beyond a predetermined limit and for preventing open anodes caused by a faulty computer signal.

Briefly described, these and other objects of the invention are accomplished by providing the anode support structure of a computer-operated aluminum electrolytic reduction cell with a pneumatic system for controlling an air motor and its associated anode jack. The pneumatic system includes a ball-cam valve for cancelling or interrupting, at a predetermined height, a cell-operator or computer-initiated pilot air signal through a first three-way valve to a second three-way valve which is actuated to admit supply air to the air motor and thereby operate the jack to raise the anode support structure. The computer-initiated signal also supplies pilot air to a flow control valve and accumulator, series connected to the first three-way valve. When the accumulator pressure increases to a predetermined magnitude, the pilot air signal from the accumulator activates the first three-way valve to interrupt pilot air to the second three-way valve thereby shifting such valve to block the air supply to the air motor and stop the vertical movement of the anode support structure. By appropriate adjustment of the flow control valve, the time duration between computer initiation of a pilot air signal and stoppage of supply air to the air motor may be varied. In this manner, "up" anode signals from the computer that require operation of the air motor for a time period greater than the time duration preset with the flow control valve will be terminated.

The accumulator and flow control valve are connected so as to provide a safeguard only against erroneous or faulty computer-initiated signals. To afford increased system flexibility, cell-operator-initiated pilot air signals to raise the anode support structure do not flow through the accumulator and flow control valve and, consequently, are not limited to the preset time duration. The provision of the aforementioned prior art voltage monitoring, visual and audible alarm safeguards is generally sufficient to prevent an operator-initiated open anode condition.

With these and other objects, advantages and features of the invention that may become hereinafter apparent, the nature of the invention may be more clearly understood by reference to the following detailed description, the appended claims and to the illustrative embodiment shown in the attached drawings.

DETAILED DESCRIPTION OF A PREFERRED EMBODIMENT

Figure 1:
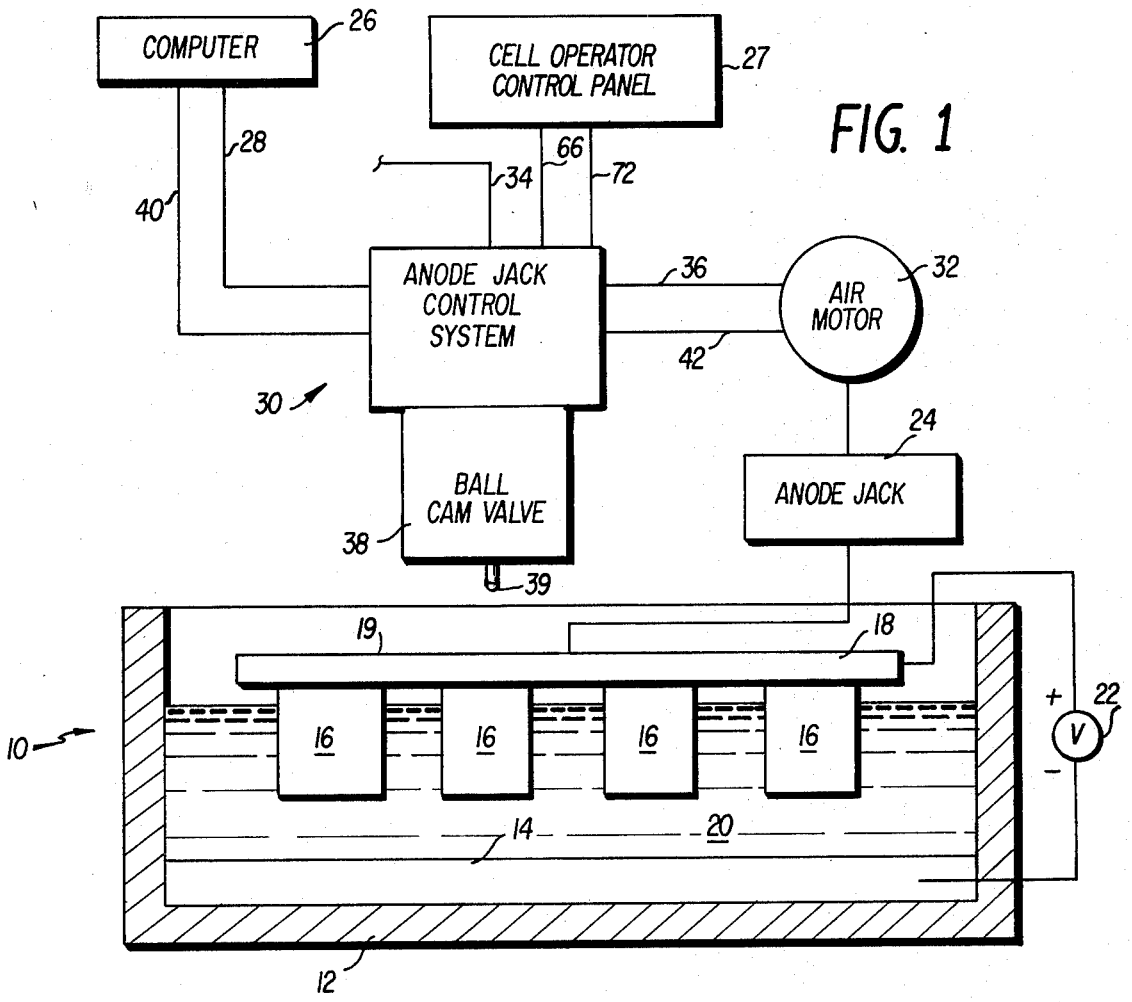
FIG. 1 is a schematic view of an aluminum reduction cell incorporating the anode jack control system of the present invention.

Referring now in detail to the drawings, there is illustrated in FIG. 1 an aluminum electrolytic reduction cell designated generally by reference numeral 10. The reduction cell comprises a vessel or pot 12 having a cathode 14 formed of collecting bars embedded in the bottom of the vessel 12. A plurality of carbon anode blocks 16 is suitably affixed to an anode support structure 18 in superposed relation to the vessel 12. The anode blocks 16 are immersed in molten electrolyte 20 contained within the vessel 12 so that the voltage across the cell, as measured by a voltmeter 22, is maintained at a precalculated magnitude in a manner well-known to those skilled in the art. One or a plurality of anode jack devices 24 is connected to the anode support structure 18 for raising or lowering the same relative to the vessel 12.

Figure 2:
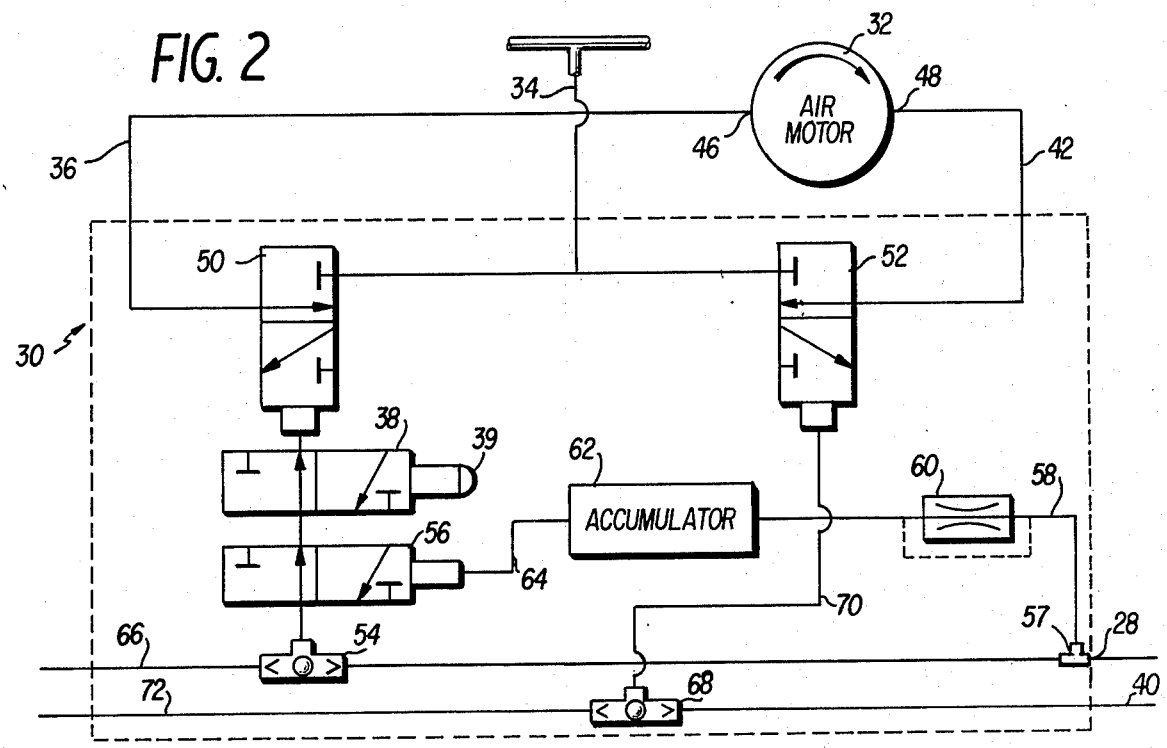
FIG. 2 is a schematic illustration of an anode jack control system showing one arrangement of the various system components.

Jack device 24 is actuated by means of an air motor 32 supplied with air from a pneumatic source (not shown) through main air supply line 34. The air motor 32 may be caused to rotate in either a first direction or a second direction to actuate the jack 24 to raise or lower the support structure 18 according to the operation of an anode jack control system 30 which includes three-way valves 50, 52 (FIG. 2). The valves 50, 52 are selectively controlled through suitable pilot lines from either a computer 26 or a cell operator control panel 27 in a manner to be hereinafter described.

The computer 26 is programmed in such a manner that when the voltage across the cell 10 exceeds a predetermined magnitude, a pneumatic control signal will be generated in a pilot air line 28. This pneumatic control signal is transmitted to the anode jack control system 30 which introduces air pressure to air motor 32 from main air supply line 34 through a pneumatic line 36. The air motor 32 rotates in a direction to cause the anode jack 24 to raise the support structure 18 and anode blocks 16, thereby decreasing cell voltage. When the voltage across the cell 10 drops below a predetermined magnitude, the computer 26 will cause a pneumatic signal to be generated in a pilot air line 40 and transmitted to the anode jack control system 30. In response to this pneumatic signal, main air from line 34 is admitted to the air motor 32 through line 42 to rotate the air motor in a direction to cause the anode jack 24 to lower the support structure 18. Ball-cam valve 38 is positioned as diagrammatically shown in a fixed relation to the reduction cell 10 and establishes an upper limit of vertical movement of the support structure 18 above which the pneumatic circuit of the anode jack control system 30 will be rendered inoperative. The operation of the ball-cam valve 38 will be better understood by referring to FIG. 2 and the following description thereof.

FIG. 2 illustrates further details of the anode jack control system 30 of the present invention. The main air line 34 supplies air under suitable pressure to an inlet 46 of the air motor 32 through the pilot-operated three-way valve 50 and line 36. This causes the air motor 32 to rotate in the direction shown by the arrow, thereby causing the anode jack 24 to raise the anode blocks 16. Line 34 also supplies main air to an air motor inlet 48 via the pilot-operated three-way valve 52 and line 42 to rotate the air motor oppositely of the direction shown by the arrow. This causes the anode jack 24 to lower the anode blocks 16.

A computer-initiated pilot air signal to raise the anode blocks 16 is transmitted through line 28 to a shuttle valve 54, thence through another pilot-operated three-way valve 56 and the ball-cam valve 38 to operate the pilot-operated three-way valve 50. Simultaneously, a portion of the computer-initiated pilot air signal in line 28 is bypassed at tee connection 57 into a line 58 through an adjustable flow control valve 60, an air accumulator 62 and a line 64 to operate the pilot-operated three-way valve 56. A computer-initiated pilot air signal to lower the anode blocks 16 is transmitted through line 40 to a shuttle valve 68 and a line 70 to operate the pilot-operated three-way valve 52.

With the electrolytic cell 10 operating in a computer-controlled mode, the system operates in the following manner. A pilot air signal from the computer 26 to raise the anode blocks 16 will be transmitted as described above via line 28, shuttle valve 54, three-way valve 56 and ball-cam valve 38 to shift three-way valve 50. This permits the introduction of main air from line 34 into inlet 46 of the air motor 32. The pilot air signal in line 58, diverted from line 28 at tee connection 57, will simultaneously flow into the accumulator 62 at a rate regulated by the adjustable flow control valve 60. When the pressure in the accumulator 62 increases sufficiently to actuate or shift three-way valve 56 via line 64, the pilot air signal to three-way valve 50 will be blocked and the pilot air from line 28 will be dumped to atmosphere. The time required for the pressure to increase in accumulator 62 to a magnitude sufficient to actuate three-way valve 56 can be controlled by adjusting the flow rate through the adjustable flow control valve 60. Computer-initiated pilot air signals to raise the anode blocks 16 may, therefore, be limited to a time duration which will preclude a faulty or erroneous computer signal from raising the anode blocks out of the molten electrolyte and creating an open anode condition.

Valve 50 may also be supplied with pilot air independently of the computer signal, accumulator 62 and flow control valve 60 from the cell operator control panel 27 via a bypass pilot air line 66. Similarly, valve 52 may be independently supplied with pilot air from the control panel 27 through a bypass pilot air line 72. The admission of the independent or bypass pilot air signals to lines 66 and 72 is controlled manually by a cell operator using the control panel 27 (FIG. 1) and permits greater flexibility of system operation. For example, operator-initiated pilot air signals from the control panel 27 via line 66 to raise the anode support structure 18 are not limited to the time duration set by the pneumatic circuit through flow control valve 60 and as replacing consumed anode blocks and the like, can be more expeditiously accomplished. Moreover, in the event of a computer breakdown or repair, operation of the reduction cell 10 may be continued manually by a cell operator using the control panel 27.

Both computer and cell-operator-initated pilot air signals to raise the anode blocks 16 flow from the shuttle valve 54 to the three-way valve 50 via the ball-cam valve 38 which is positioned in a predetermined fixed relation to the anode support structure 18 (FIG. 1). The cam 39 of ball-cam valve 38 is arranged in such a manner that it will be actuated by contact with the upper surface 19 of the support structure 18 should the same be raised above a predetermined maximum point. Whenever a pilot air signal from either line 28 or 66 to three-way valve 50 is of sufficient duration to cause the anode jack 24 to raise the support structure 18 into contacting relation with the cam 39, ball-cam valve 38 will shift and dump the pilot air signal to atmosphere. This will cause termination of the pilot air signal to three-way valve 50 which will shift and block main air to the air motor 32 thereby stopping upward movement of the support structure 18. Main air from line 34 cannot again be introduced into the air motor 32 until the upper surface 19 of the support structure 18 is moved downwardly to free the cam 39 of ball-cam valve 38.

Lowering of the support structure 18 and anode blocks 16 is accomplished by supplying pilot air either from the computer 26 via the line 40 or from the cell operator control panel 27 via line 72 to shuttle valve 68 and line 70 to actuate pilot-operated three-way valve 52. Actuation of valve 52 will admit main air from main air line 34 to line 42 and the inlet 48 of air motor 32 to rotate the air motor in a direction opposite that shown by the arrow. This will cause the anode jack 24 to lower the anode support structure 18.

In view of the foregoing, it should be apparent that there is provided by the present invention a novel anode jack control system which prevents the occurrence of an open anode condition and precludes the possibility of damage to the anode support structure, jacks and associated hardware. Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. In an aluminum electrolytic reduction cell comprising a vessel adapted to contain a molten electrolyte, a cathode electrically connected to the electrolyte, an anode support structure arranged in superposed relation to said vessel and having an anode attached thereto for immersion in the electrolyte, jack means cooperating with the support structure for raising and lowering the anode, computer means operatively connected to said jack means for generating a signal to raise or lower the anode and means for transmitting the signal to said jack means, the improvement comprising control means interposed between said computer means and said jack means and connected to said signal transmitting means for controlling the signal transmitted to said jack means, said control means including means for interrupting the signal from said computer means to said jack means when the signal exceeds a predetermined time duration.

2. The combination of claim 1 wherein said control means further includes limit stop means for interrupting the signal from said computer means to said jack means when said support structure is raised to a predetermined height in relation to said vessel.

3. The combination of claim 1 wherein said signal is a pneumatic signal and wherein said signal interrupting means includes in series, a flow control valve, an accumulator and a first valve means, said first valve means being connected to said signal transmitting means and having a first operative position for blocking the signal transmitted to the jack means when the pressure in the accumulator reaches a predetermined magnitude and a second operative position for transmitting the signal to the jack means.

4. The combination of claim 1 wherein said control means includes means bypassing said signal interrupting means for generating and transmitting a signal to said jack means to raise or lower the anode.

5. The combination of claim 2 wherein said signal is a pneumatic signal and wherein said limit stop means includes a ball-cam valve operatively connected to said signal transmitting means, said ball-cam valve being arranged in fixed relation to the movable support structure to block the pneumatic signal transmitted to said jack means when the support structure is raised into contacting relation with said ball-cam valve.

6. The combination of claim 3 wherein said flow control valve is connected to said signal transmitting means upstream of said first valve means, said flow control valve being adjustable to vary the flow therethough to said accumulator.

7. The combination of claim 3 wherein said jack means includes a jack and an air motor operatively connected to the jack, said motor being rotatable in one direction to raise the anode and in the other direction to lower the anode and wherein said control means further includes a second valve means connected to said signal transmitting means for admitting air under pressure to said motor to rotate said motor in said one direction in response to the pneumatic signal transmitted through said first valve means when said first valve means is in its second operative position.

8. The combination of claim 4 wherein said control means further includes limit stop means for interrupting the signal from said computer means and from said bypass means to said jack means when said support structure is raised to a predetermined height in relation to said vessel.

9. The combination of claim 7 wherein said control means further includes a third valve means connected to said motor for admitting air under pressure to said motor to rotate said motor in said other direction in response to a signal from said computer means to lower the anode.

* * * * *